United States Patent [19]

Greenberg

[11] Patent Number: 4,712,698

[45] Date of Patent: Dec. 15, 1987

[54] DRINKING VESSEL

[76] Inventor: Herbert S. Greenberg, 21 Via Marina #2, Marina del Rey, Calif. 90290

[21] Appl. No.: 834,569

[22] Filed: Feb. 28, 1986

[51] Int. Cl.[4] ..... B65D 23/10

[52] U.S. Cl. ..... 215/100 A; 215/1 R; D7/10

[58] Field of Search ..... 215/100 A, 1 R; 220/94 R, 94 A; D7/10, 21

[56] References Cited

U.S. PATENT DOCUMENTS

D. 166,832 5/1952 Thompson et al. ..... D7/10

D. 191,214 8/1961 Fisher ..... D7/10

3,077,286 2/1963 Cornelius ..... 215/100 A X

*Primary Examiner*—Donald F. Norton

*Attorney, Agent, or Firm*—Allan M. Shapiro

[57] ABSTRACT

Drinking vessel has side walls and closed bottom to form an open topped vessel. Secured to the side walls are handle portions which are sized and spaced for grasp between the thumb and fingers of the user. The handle portions are shaped as bridges to insulate the thumb and finger engaging recesses from the temperature of the walls.

18 Claims, 4 Drawing Figures

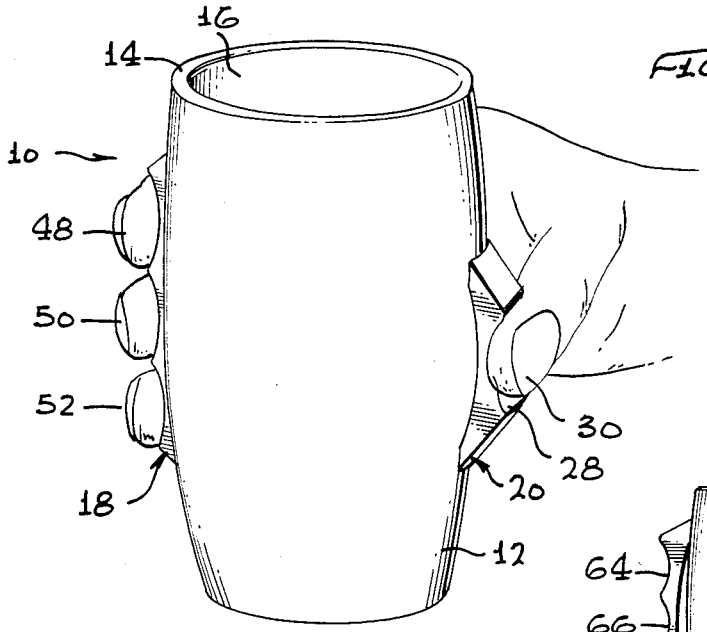
FIG. 1
FIG. 4
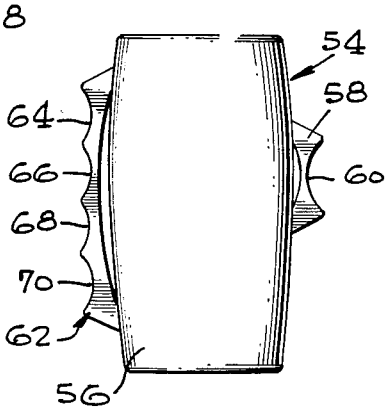
FIG. 2
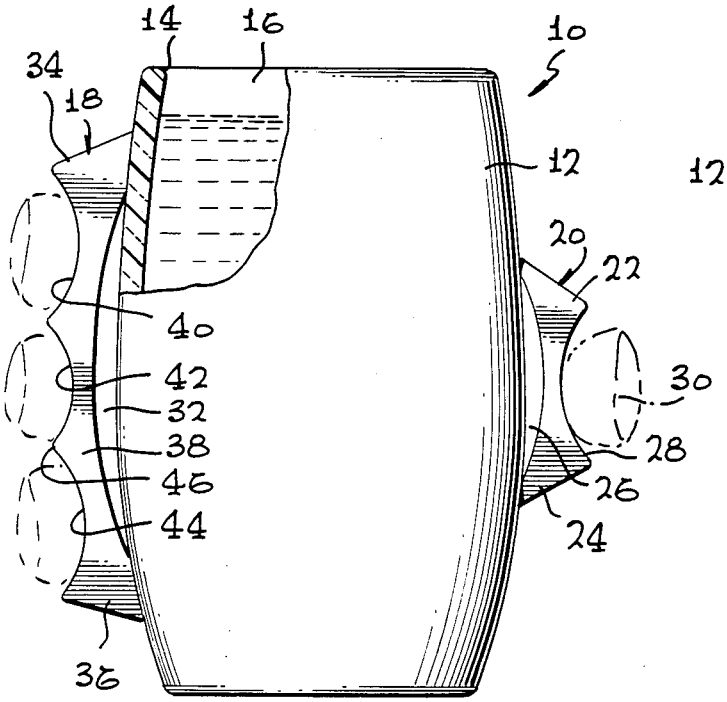
FIG. 3
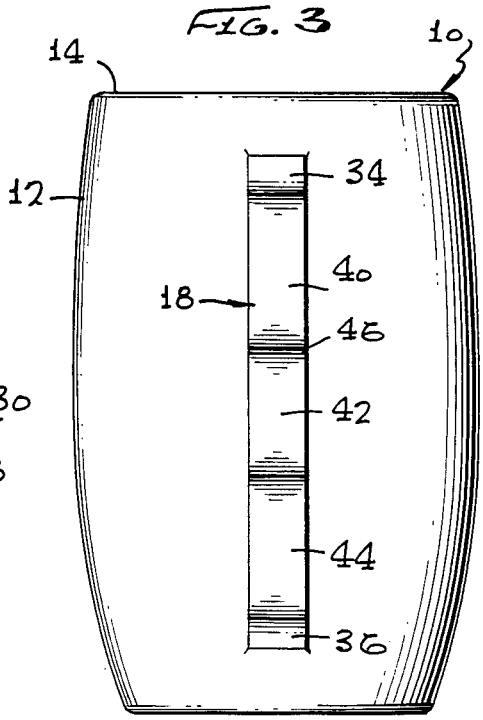

DRINKING VESSEL

BACKGROUND OF THE INVENTION

This invention is directed to a graspable drinking vessel which has protrusions on the sides thereof with the protrusions thermally insulated from the body to protect the grasping fingers from the heat of the body of the drinking vessel.

Many different configurations of drinking vessels are available. The drinking vessels fall generally into the category of cups and glasses, with cups usually being of ceramic material. When a cup is to be used for a hot drink such as hot coffee or hot tea, it is customary to provide a handle thereon so that the user can raise the cup for drinking therefrom. Such handles are on the side of the cup and provide an unbalanced load on the fingers. On the other hand, glasses are usually tall and narrow, as compared to cups, and are usually made of glass. The drinking vessels generally classed as glasses are customarily used for cool and cold drinks because they are usually not provided with any type of insulation. When filled with hot beverages, the external surface is too hot to permit it to be picked up in the fingers. Sometimes moisture condensation on the exterior of glasses containing cold drinks causes the external surface to be slippery, with the risk of dropping the glass. Thus, there is need for a drinking vessel having insulated engagement surfaces thereon which can be grasped without fear of burns or concern for slipperiness.

SUMMARY

In order to aid in the understanding of this invention, it can be stated in essentially summary form that it is directed to a drinking vessel having protrusions on the body thereof, the protrusions are partially thermally insulated from the body and are positioned to be graspable between opposed thumb and fingers.

It is a purpose and advantage of this invention to provide a drinking vessel which has insulated protrusions thereon with the body of the vessel between the protrusions and the protrusions being spaced to be graspable between the opposed thumb and fingers of the same hand so that the fingers do not need to contact the body of the vessel and thus are protected from the temperature of the body of the vessel.

It is a further purpose and advantage of this invention to provide a drinking vessel which can be made of glass or ceramic and can be used for either hot or cold beverages, with the protrusions on the sides of the vessel being insulated from the vessel body in order to insulate the thumb and finger engaging protrusions.

It is a further purpose and advantage of this invention to provide a drinking vessel which is of unique and interesting configuration and can be comfortably and safely grasped in one hand.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the first preferred embodiment of the drinking vessel of this invention, shown in the user's hand.

FIG. 2 is an enlarged side-elevational view thereof, with parts broken away and parts taken in section, with the thumb and three fingers of the user's hand shown in dashed lines.

FIG. 3 is a side-elevational view of the drinking vessel shown from the left of FIG. 2.

FIG. 4 is a side-elevational view, similar to FIG. 2 on a reduced scale, of a second preferred embodiment of the drinking vessel of this invention.

DESCRIPTION OF THE PREFERRED EMBODIMENTS

FIGS. 1, 2 and 3 illustrate the first preferred embodiment of the drinking vessel of this invention wherein it is generally indicated at 10. The vessel 10 is illustrated as having side walls 12 and an open top defined by rim 14. There is a bottom across the side walls 12 to form the open topped and otherwise closed drinking vessel. The vessel has an interior space 16 in which beverage can be placed for drinking. The side walls 12 and bottom of the drinking vessel 10 are formed as surfaces of revolution and are slightly barrel-shaped. However, the particular side wall shape is only a preferred embodiment, and the side wall shape could be of any convenient shape, such as that of right circular cylinder, oval, multi-sided. Furthermore, the side walls could be straight, tapered or barrel-shaped as shown. In addition, a separate foot could be provided. The material of drinking vessel 10 must be heat-resistant because the vessel is intended for use in serving hot beverages. Ceramic material, glass and selected synthetic polymer composition material are suitable materials.

In order to prevent the user from burning his fingers on the outer surface of the side walls when he grasps the vessel, the vessel is provided with a pair of spatially opposed handle portions 18 and 20. Together, these handle portions form means for handling the vessel. Each is insulated from the side walls of the vessel and each is configured for manual engagement. Handle portion 20 is insulated by being formed as a bridge having legs 22 and 24 attached to the side walls 12 and defining an insulating space 26 between the bridge of the handle portion and the side wall 12. In order to provide surety of grasp, the outer surface 28 of handle portion 20 is curved in a concave manner to accept the thumb 30 of the use.

Handle portion 18 also extends outwardly from the side walls 12 and is insulated therefrom. In the preferred embodiment illustrated, this insulation is in the form of insulation space 32 between legs 34 and 36 which define a bridgelike configuration of the portion 18. Thus, the handle portions 18 and 20 are very much the same, except for the length between the legs. The bridge portion 38 between the legs and over the legs is sufficiently long in the direction perpendicular to the surface on which the drinking vessel 10 would rest that there is space for three digit-receiving recesses 40, 42 and 44 in the outer surface 46 of the handle portion 18. These digit-receiving recesses are suitable for receiving the fingers 48, 50 and 52 of the user. These finger depressions 40, 42 and 44 and the thumb depression 28 are sufficiently deep to provide engagement in the grasping digits of the user so that there is no tendency for vertical slippage of the vessel between the digits.

The drinking vessel 10 is designed to be grasped in the digits between the thumb and at least two fingers in opposed relationship. The handle portions need not be directly opposite each other, but they are positioned in opposition so that during grasping, the drinking vessel is firmly held in the digits. The drinking vessel 10 is designed to be grasped and, as a result of this, the side walls 12 may be spaced more closely together than on some common cups. To maximize the diameter of the vessel portion of the drinking vessel, that is, to maximize the outside diameter of side walls 12, the handle portions must lie close to the side walls with the insulation space 28 and 32 minimized. Thus, these spaces are merely air gaps and are much too small for finger access. The insulation space 26 and 32 is shown as an air space which provides good insulation for the purpose intended. However, other thermal insulating materials may be used in the insulation space. The purpose of the insulation is to prevent the digit-receiving recesses from reaching an uncomfortable temperature when the vessel is filled with a hot beverage.

When an ordinary drinking vessel, such as a glass, is filled with a cold beverage, quite often moisture condenses on the outer surface to make the glass slippery. When the vessel 10 is employed for cold beverages, the handle portions 18 and 20 are also insulated from that cold so as to resist condensation on the digit-receiving surfaces. Thus, the drinking vessel 10 is secure from slippery condensation when employed for serving cold beverages. The grasp of the handle portions between the digits provides security and comfort for serving hot or cold beverages.

The preferred embodiment 10 of the drinking vessel illustrated in FIGS. 1, 2 and 3 has a handle portion 18 with three recesses for receiving three fingers. This is because the first, second and third fingers do most of the finger engagement in most tasks and the fourth finger is less used. The drinking vessel 54 illustrated in FIG. 4 has side walls 56, a closed bottom and open top the same as the drinking vessel 10 so that it can serve as such a vessel. Furthermore, the drinking vessel 54 has a handle portion 58 identical to the handle portion 20. It has a thumb depression 60 for grasp by the thumb in normal grasping manner. Positioned in opposition to the handle portion 58 is handle portion 62, which is similar to handle portion 18. The difference is that the handle portion 62 has four finger-receiving depressions 64, 66, 68 and 70. In this way, all four fingers of the user's hand may be placed in a depression in the handle portion 62 while the thumb of the same hand engages in thumb depression 60 in handle portion 58. The handle portions 58 and 62 are each in the form of a bridgelike construction to provide insulation from the temperature of the side walls 56.

In another but unillustrated preferred embodiment, a drinking vessel having two of the handle portions 62 or two of the handle portions 18 positioned in opposition to each other could be employed. In such a construction, the thumb would engage in one of the receiving depressions of one of the handle portions while the three or four fingers engage in the corresponding recesses in the handle portion on the opposite side of the vessel. With this construction, the fingers could equally well engage on either of the handle portions while the thumb engages on the handle portion in opposition thereto. With such a construction, the drinking vessel would be symmetrical.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A drinking vessel comprising:

walls defining a closed side, closed bottom and open top vessel;

first and second opposed handle portions positioned on substantially opposite sides of said vessel, each of said handle portions having an external digit engagement surface and being secured to said vessel for manual engagement of said vessel by grasp of both of said handle portions within the digits of the same hand, said handle portions each having at least one digit-receiving depression on the outer surface thereof so that manual grasp of said drinking vessel and digit engagement of said handle portions comprises digit engagement in said depression; and insulation of a different material than said vessel between said engagement surface and said vessel.

2. The drinking vessel of claim 1 wherein said handle portions are thermally insulated from said side walls of said vessel.

3. The drinking vessel of claim 2 wherein at least one of said handle portions is formed as a bridge having legs secured to said side walls of said vessel and having a space between said legs and between the intermediate section of said handle portion so that said handle portion is partially thermally isolated from said side walls by means of said space.

4. The drinking vessel of claim 3 wherein said handle portions are first and second handle portions and both said first and second finger handle portions are formed as a bridge having first and second legs.

5. The drinking vessel of claim 3 wherein said space is sufficientLy small to prevent finger access therethrough.

6. The drinking vessel of claim 1 wherein there is one depression in the external surface of one of said handle portions and at least three depressions in the external surface of the other of said handle portions so that said vessel may be grasped between the thumb and three fingers of the same hand.

7. A drinking vessel comprising:

walls defining a closed side, closed bottom and open top vessel;

a pair of spatially opposed handle portions, each of said handle portions being thermally insulated from said sides of said vessel and being secured to said vessel for manual engagement of said vessel by grasp of both of said handle portions within the digits of the same hand, at least one of said handle portions being formed as a bridge having legs secured to said side walls of said vessel and having a space between said legs and between the intermediate section of said handle portion so that said handle portion is partially thermally isolated from said side walls by means of said space, said space being sufficiently small to prevent finger access therethrough.

8. The drinking vessel of claim 7 wherein said handle portions are first and second handle portions and both said first and second finger handle portions are formed as a bridge having first and second legs.

9. The drinking vessel of claim 7 wherein both said first and second finger handle portions are formed as a bridge having first and second legs.

10. A drinking vessel comprising:

walls defining a closed side, closed bottom and open top vessel;

first and second opposed handle portions, each of said first and second handle portions being formed as a bridge having first and second legs with said legs being secured to said vessel and having a space between said legs and between the intermediate section of said handle portions so that each said handle portion is partially thermally isolated from said side walls by means of said space said handle portions each having at least one digit-receiving depression on the outer surface thereof so that manual grasp of said drinking vessel and digit engagement of said handle portions comprises digit engagement in said depressions so that said vessel is manually engaged by grasp of both of said handle portions within the digits of the same hand.

11. The drinking vessel of claim 10 wherein there is one depression in the external surface of one of said handle portions and at least three depressions in the external surface of the other of said handle portions so that said vessel may be grasped between the thumb and three fingers of the same hand.

12. A drinking vessel comprising:

walls defining the sides and bottom of an open top drinking vessel;

first and second spatially opposed handle portions secured to said side walls, each of said first and second handle portions being formed of the same material as said walls and each being formed as a bridge having first and second spaced legs and a span thereacross so as to define an insulation space beneath said span, between said legs and outside of said side wall so that said span is at least partially thermally insulated from said side walls;

at least one depression in said first handle portion for receiving the thumb of the user, at least three finger-receiving depressions in said second of said handle portions for receiving three fingers of the user, said thumb-receiving recess in said first handle portion and said finger-receiving recesses in said second handle portion being close enough to be grasped in one hand of the user so that when the user so grasps the drinking vessel his thumb and fingers are at least partially thermally insulated from the temperature of a liquid in said drinking vessel.

13. The drinking vessel of claim 12 wherein the insulation space beneath said spans is air space and said air space is sufficiently small to prevent finger access therein.

14. The drinking vessel of claim 13 wherein there are four finger depressions in said second handle portion.

15. The drinking vessel of claim 14 wherein there is one thumb depression in said first handle portion.

16. The drinking vessel of claim 13 wherein said walls and said handle portions are made of ceramic.

17. A drinking vessel comprising:

walls defining the sides and bottom of an open top drinking vessel;

first and second spatially opposed handle portions secured to said side walls, each of said first and second handle portions being formed of the same material as said walls and each being formed as a bridge having first and second spaced legs and a span thereacross so as to define an insulative air space beneath said span, said air space being sufficiently small to prevent finger access therein so that said span is at least partially thermally insulated from said side walls;

at least one depression in said first handle portion for receiving the thumb of a user, three finger depressions in said second handle portion for receiving three fingers of the user, said thumb-receiving recess in said first handle portion and said three finger-receiving recesses in said second handle portion being close enough to be grasped in one hand of the user so that when the user so grasps the drinking vessel his thumb and fingers are at least partially thermally insulated from the temperature of a liquid in said drinking vessel.

18. The drinking vessel of claim 17 wherein there is one thumb depression in said first handle portion.

* * * * *